US007396291B2

(12) United States Patent
Lo

(10) Patent No.: US 7,396,291 B2
(45) Date of Patent: Jul. 8, 2008

(54) GOLF CLUB HEAD AND MANUFACTURING METHOD THEREFOR

(75) Inventor: Lai-Fa Lo, Taoyuan (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 308 days.

(21) Appl. No.: 11/133,256

(22) Filed: May 20, 2005

(65) Prior Publication Data

US 2006/0199665 A1 Sep. 7, 2006

(30) Foreign Application Priority Data

Mar. 3, 2005 (TW) ..... 94106404 A

(51) Int. Cl.
*A63B 53/04* (2006.01)

(52) U.S. Cl. ..... 473/324; 473/345; 473/349

(58) Field of Classification Search ..... 473/324–350
See application file for complete search history.

(56) References Cited

U.S. PATENT DOCUMENTS 5,704,850 A * 1/1998 Shieh ..... 473/324
6,334,817 B1 * 1/2002 Ezawa et al. ..... 473/324
6,565,452 B2 * 5/2003 Helmstetter et al. ..... 473/342
6,739,984 B1 * 5/2004 Ciasullo ..... 473/345
6,749,524 B1 * 6/2004 Chen ..... 473/342
6,780,124 B2 * 8/2004 Lu ..... 473/342
2004/0185960 A1 * 9/2004 Chen ..... 473/342

FOREIGN PATENT DOCUMENTS

JP 2002165902 A * 6/2002
JP 2002186695 A * 7/2002
JP 2003180885 A * 7/2003
TW M249897 A 11/2004

* cited by examiner

*Primary Examiner*—Alvin A Hunter
(74) *Attorney, Agent, or Firm*—Muncy, Geissler, Olds & Lowe, PLLC

(57) ABSTRACT

A golf club head includes a body having at least one assembling opening and at least one cover plate mounted in the at least one assembling opening. A plurality of spaced spot welding points are provided along a joint area between the cover plate and the perimeter wall of the assembling opening. A brazing bonding portion is located between a pair of the spaced spot welding points adjacent to each other. The spot welding points and the brazing bonding portions securely fix the cover plate in the assembling opening to improve the bonding reliability.

12 Claims, 9 Drawing Sheets

GOLF CLUB HEAD AND MANUFACTURING METHOD THEREFOR

BACKGROUND OF THE INVENTION

1. Field of the Invention

The present invention relates to a golf club head and a method for manufacturing the golf club head.

2. Description of Related Art

It is a trend to reduce the thickness of a member (e.g., a cover plate) of a golf club head for improving elastic deformability of the member. It is therefore an important task to reduce the thickness of the member while securely mounting the member on the golf club head.

The member is generally mounted to the golf club head by welding or brazing. For example, a cover plate can be fixed in a top opening of a golf club head by welding or brazing. In a case that the thickness of the cover plate is reduced to a certain extent and that the cover plate is mounted to the top opening by conventional welding such as Argon welding, recessions are apt to be formed in the seam along a perimeter of the cover plate. The qualified product rate is thus low. On the other hand, if the cover plate is mounted to the top opening by brazing to avoid generation of the recessions, sufficient engaging strength could not be obtained between a front edge of the cover plate and a perimeter wall delimiting the top opening. As a result, the brazing area in the front edge of the cover plate (that is adjacent to the striking face and thus has a relatively larger deformation when subjected to momentum during striking) is liable to crack due to the momentum.

Taiwan Utility Model Publication No. M249697 discloses a hollow golf club head with an opening in a top face thereof and a cover plate mounted in the opening. The golf club head includes a perimeter wall extending along the opening, with at least one groove being defied in the perimeter wall. The cover plate includes an engaging rib. During brazing, the engaging rib is inserted into the groove to position the cover plate in the top face of the golf club head for improving the engaging reliability. However, high precision is required for forming the groove and the engaging rib. Further, the cover plate could not be manufactured by casting or forging that is suitable for rapid manufacture purposes. In other words, complex manufacturing processes are required and the cost is increased.

OBJECTS OF THE INVENTION

An object of the present invention is to provide a golf club head that provides improved engaging reliability.

Another object of the present invention is to provide a golf club head that has a simplified structure.

A further object of the present invention is to provide a method for manufacturing a golf club head with improved engaging reliability.

Still another object of the present invention is to provide a method for manufacturing a golf club head with a simplified structure.

SUMMARY OF THE INVENTION

In accordance with an aspect of the present invention, a golf club head includes a body having at least one assembling opening and at least one cover plate mounted in the at least one assembling opening. A plurality of spaced spot welding points are provided along a joint area between the at least one cover plate and the perimeter wall delimiting the at least one assembling opening. A brazing bonding portion is located between a pair of the spaced spot welding points adjacent to each other. The spot welding points and the brazing bonding portions securely fix the at least one cover plate in the at least one assembling opening to improve the bonding reliability.

Preferably, the perimeter wall delimiting the at least one assembling opening includes a stepped portion for supporting the at least one cover plate.

In an embodiment of the invention, the at least one cover plate includes a perimeter flange along a bottom of a perimeter thereof. The perimeter flange engages with the perimeter wall delimiting the at least one assembling opening.

The spot welding points may be formed by high-energy full-penetration welding.

Preferably, the at least one cover plate has a thickness of 0.1-1.0 mm.

In another embodiment of the invention, the at least one cover plate includes a plurality of lugs on a perimeter thereof for indicating positions for forming the spot welding points, and a brazing material for forming each brazing bonding portion is filled into a space between a pair of the lugs.

In a further embodiment of the invention, the perimeter wall delimiting the at least one assembling opening includes a plurality of inwardly projecting lugs for supporting a perimeter of the at least one cover plate and for indicating positions for forming the spot welding points, and a brazing material for forming each brazing bonding portion is filled into a space between a pair of the lugs.

Preferably, the at least one assembling opening is defined in at least one of a crown, sole, rear, and skirt of the body.

The golf club head may be of wooden type, iron type, utility type, or putter type.

In accordance with a second aspect of the present invention, a method for manufacturing a golf club head comprises preparing a golf club head body with at least one assembling opening; preparing at least one cover plate and placing the at least one cover plate in the at least one assembling opening; forming a plurality of spot welding points along a joint area between the at least one cover plate and a perimeter wall delimiting the at least one assembling opening by welding; applying a brazing material along the joint area between the at least one cover plate and the perimeter wall delimiting the at least one assembling opening; and melting the brazing material by heating to cause molten brazing material to fill gaps between the at least one cover plate and the perimeter wall delimiting the at least one assembling opening, thereby forming a brazing bonding portion between a pair of the spot welding points adjacent to each other.

Preferably, the perimeter wall delimiting the at least one assembling opening includes an outwardly projecting perimeter flange for preventing the brazing material from flowing out of the perimeter wall delimiting the at least one assembling opening. The perimeter flange is removed after formation of the brazing bonding portions.

Preferably, the spot welding points are formed by high-energy full-penetration welding via a high-energy source. The high-energy source may be a laser beam, electronic beam, and plasma. Alternatively, the spot welding points are formed by welding in an Argon-protected environment.

Preferably, the perimeter wall delimiting the assembling opening the at least one assembling opening is made of metal or alloy.

Preferably, the at least one cover plate is made of metal or alloy.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

DETAILED DESCRIPTION OF THE PREFERRED EMBODIMENTS

Figure 1:
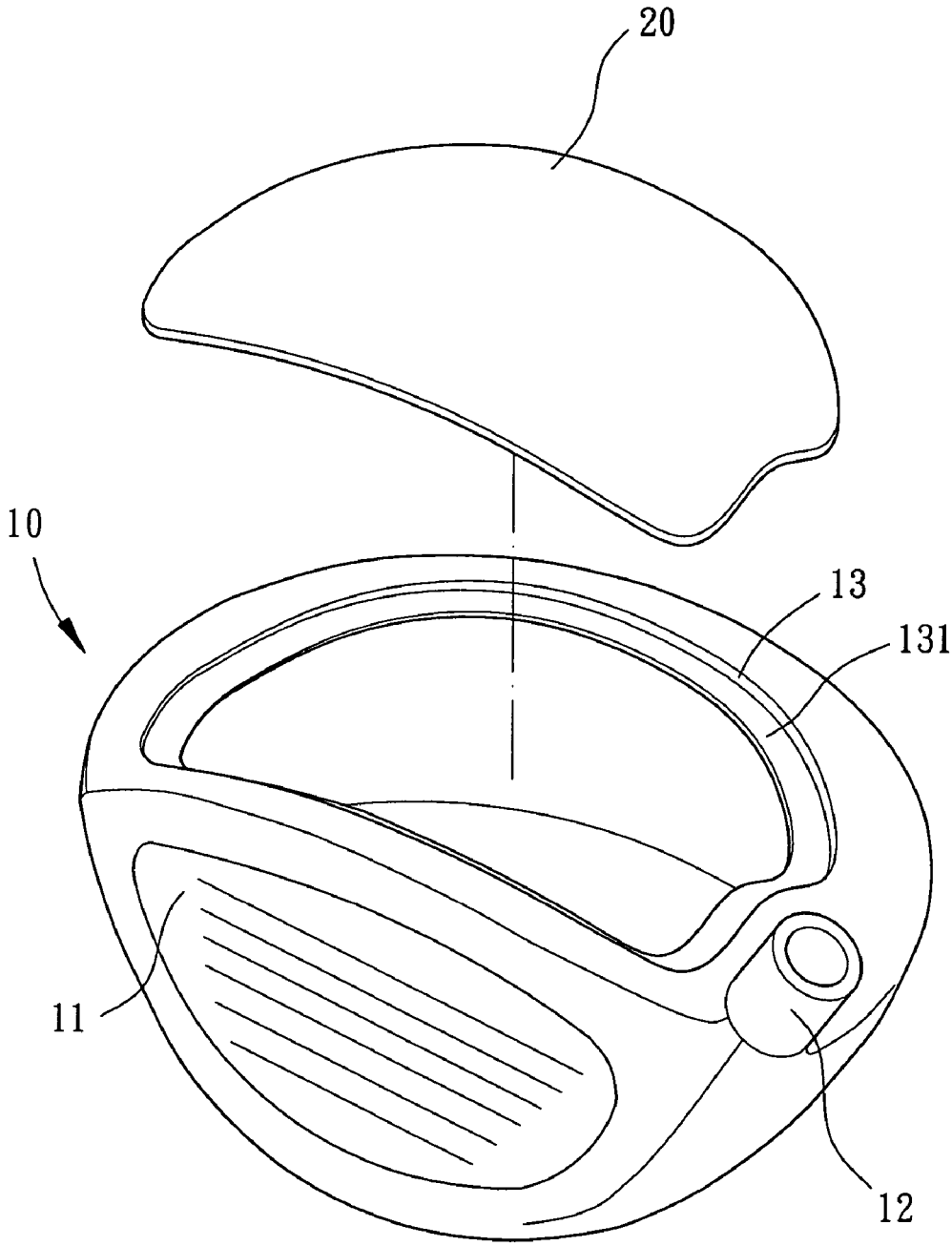
FIG. 1 is a perspective view, partly exploded, of a first embodiment of a golf club head in accordance with the present invention.

Referring to FIG. 1, a first embodiment of a golf club head in accordance with the present invention comprises a body 10 and a cover plate 20 that are bonded together by high-energy spot welding and high-temperature brazing. In the illustrated embodiment, the golf club head is of wood type. Nevertheless, the structure of the golf club head in accordance with the present invention can be used as golf club heads of other types, such as iron type, utility type, putter type, etc.

Still referring to FIG. 1, the body 10 includes a striking plate 11, a hosel 12, and at least one assembling opening 13. In this embodiment, the striking plate 11 is integrally formed with the body 10 or fixed to a front side of the body 10 by welding, brazing, bonding, insertion, or screwing. Thus, a striking face is provided on the front side of the body 10 for striking a golfball (not shown). Similarly, the hosel 12 is integrally formed with the body 10 or fixed to a side of the body 10 by welding, brazing, bonding, insertion, or screwing. A shaft (not shown) is engaged with the hosel 12.

The assembling opening 13 is defined in a crown (top side) of the body 10. Alternatively, the assembling opening 13 can be defined in a sole, rear, or skirt of the body 10. A stepped portion 131 is formed along a perimeter wall delimiting the assembling opening 13. The perimeter wall delimiting the assembling opening 13 is made of metal or alloy so that welding and brazing can be carried out in the assembling opening 13.

Still referring to FIG. 1, the cover plate 20 is made of metal or alloy suitable for welding and brazing. The cover plate 20 has a thickness that is smaller than that of the body 10. In an example, the cover plate 20 has a thickness of 0.1-1.0 mm to provide an excellent elasticity, i.e., the cover plate 20 has a high coefficient of restitution (COR).

A method for manufacturing the first embodiment of the golf club head in accordance with the present invention comprises: (1) preparing a body 10 with an assembling opening 13, (2) preparing a cover plate 20 and placing the cover plate 20 into the assembling opening 13, (3) forming a plurality of spaced spot welding points 30 on a joint area between the cover plate 20 and a perimeter wall delimiting the assembling opening 13 by welding, (4) applying a brazing material 4 along the joint area between the cover plate 20 and the perimeter wall delimiting the assembling opening 13, and (5) melting the brazing material 4 by heating to cause molten brazing material to permeate into gaps between the cover plate 20 and the assembling opening 13, thereby forming a brazing bonding portion between a pair of the spot welding points adjacent to each other.

Figure 2:
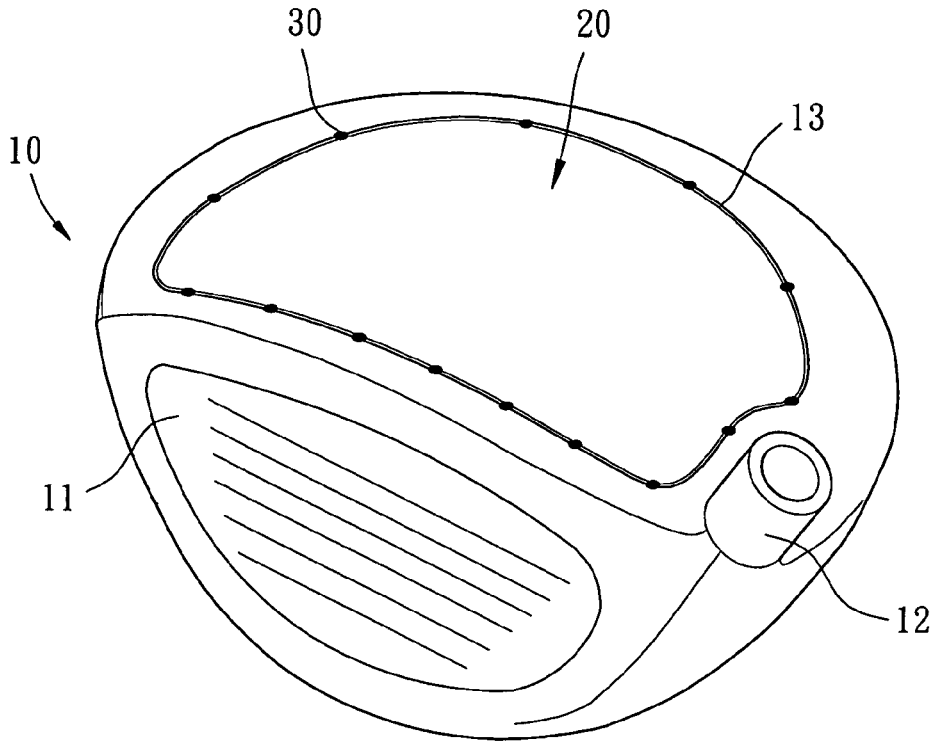
FIG. 2 is a perspective view of the golf club head in FIG. 1, illustrating a process of spot welding.

Referring to FIG. 2, in the beginning of the manufacturing procedure of the golf club head, the cover plate 20 is placed into the assembling opening 13 and supported by the stepped portion 131. Next, high-energy spot welding is carried out to form a plurality of spaced spot welding points 30 on a joint area between the cover plate 20 and the perimeter wall delimiting the assembling opening 13 with high-energy full-penetration welding. A laser beam, electronic beam, or plasma can be used as the high-energy source. More spot welding points 30 can be provided in a front edge of the cover plate 20, as the front edge of the cover plate 20 is adjacent to the striking face and thus has a relatively larger deformation when subjected to momentum during striking. The structural strength of the front edge of the cover plate 20 is improved from the standpoint of withstanding the striking momentum. It is noted that the high-energy welding can be replaced with welding in an Argon-protected environment to form the spot welding points 30.

Figure 3:
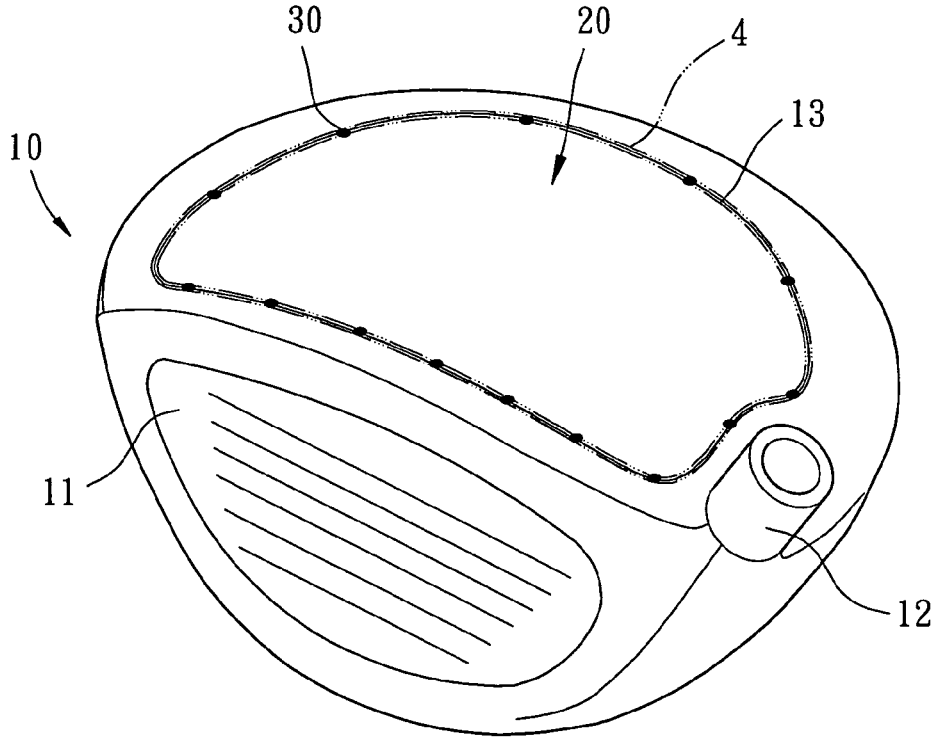
FIG. 3 is a perspective view similar to FIG. 2, illustrating application of brazing material.
Figure 4:
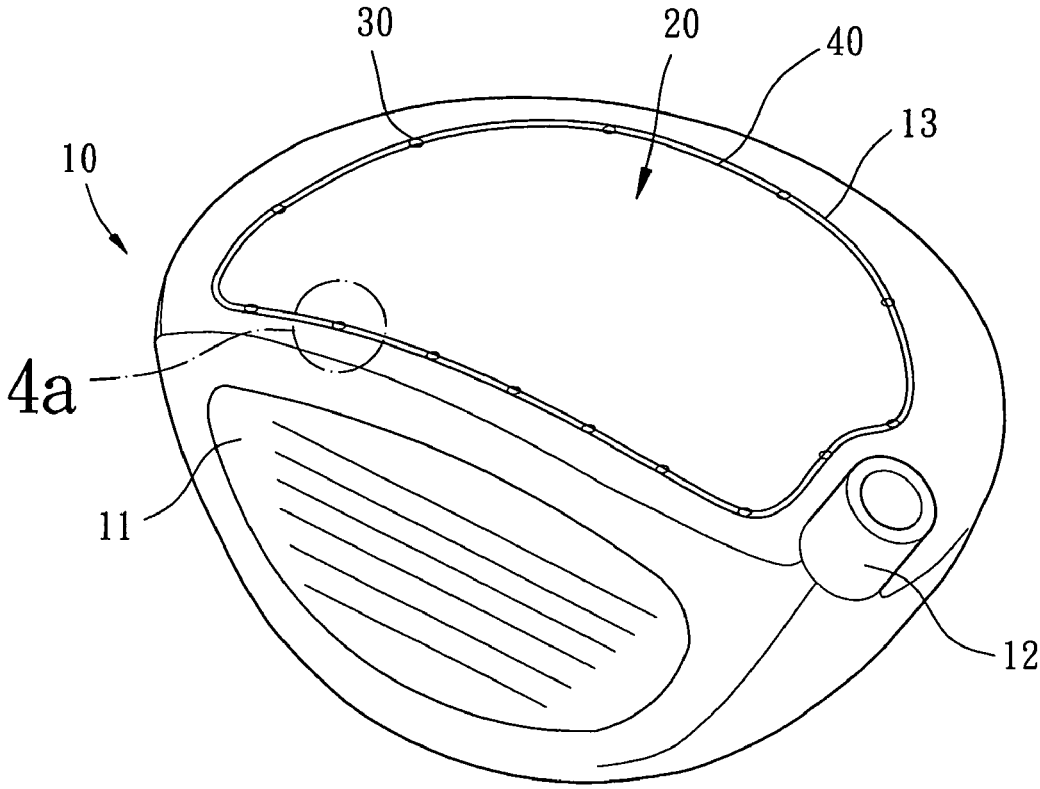
FIG. 4 is a perspective view similar to FIG. 3, illustrating the resultant golf club head after brazing.
Figure 4A:
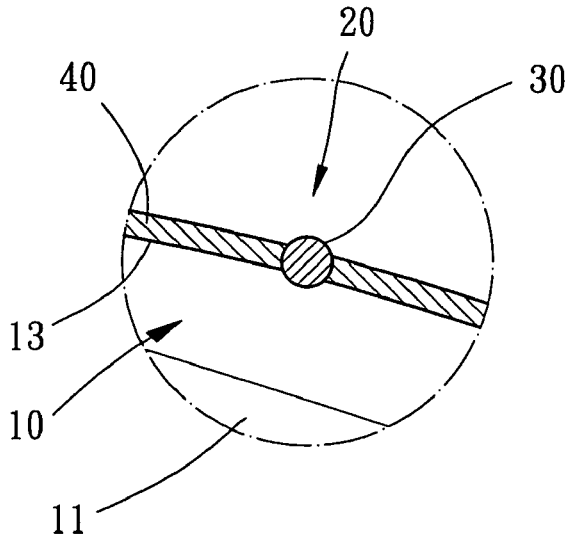
FIG. 4*a* is an enlarged view of a circled portion in FIG. 4.

Referring to FIGS. 3, 4, and 4*a*, high-temperature brazing is carried out after high-energy welding. Firstly, a paste-like or strip-like brazing material 4 is applied or fixed to the joint area between the cover plate 20 and the perimeter wall delimiting the assembling opening 13. The body 10/cover plate 20 is then placed in a vacuum oven (not shown) and heated to melt the brazing material. The molten brazing material permeates into and thus fills the gaps between the cover plate 20 and the perimeter wall delimiting the assembling opening 13. The molten brazing material also fills local recessions generated by the spot welding points 30. Then, the body 10/cover plate 20 is removed from the vacuum oven and appropriate cooling procedure is carried out. A plurality of brazing bonding portions 40 are thus formed in the joint area between the cover plate 20 and the perimeter wall delimiting the assembling opening 13.

Referring to FIGS. 4 and 4*a*, after grinding for removing redundant material, a brazing bonding portion 40 is located between a pair of spot welding points 30 adjacent to each other. The cover plate 20 and the perimeter wall delimiting the assembling opening 13 are thus reliably engaged with each other by the brazing bonding portions 40 and the spot welding points 30. In particular, the bonding area between the front edge of the cover plate 20 and the associated portion of the perimeter wall delimiting the assembling opening 13 is improved in strength with a simple structure and a simple manufacturing method. The manufacturing cost is low and the qualified product rate is increased.

Figure 5:
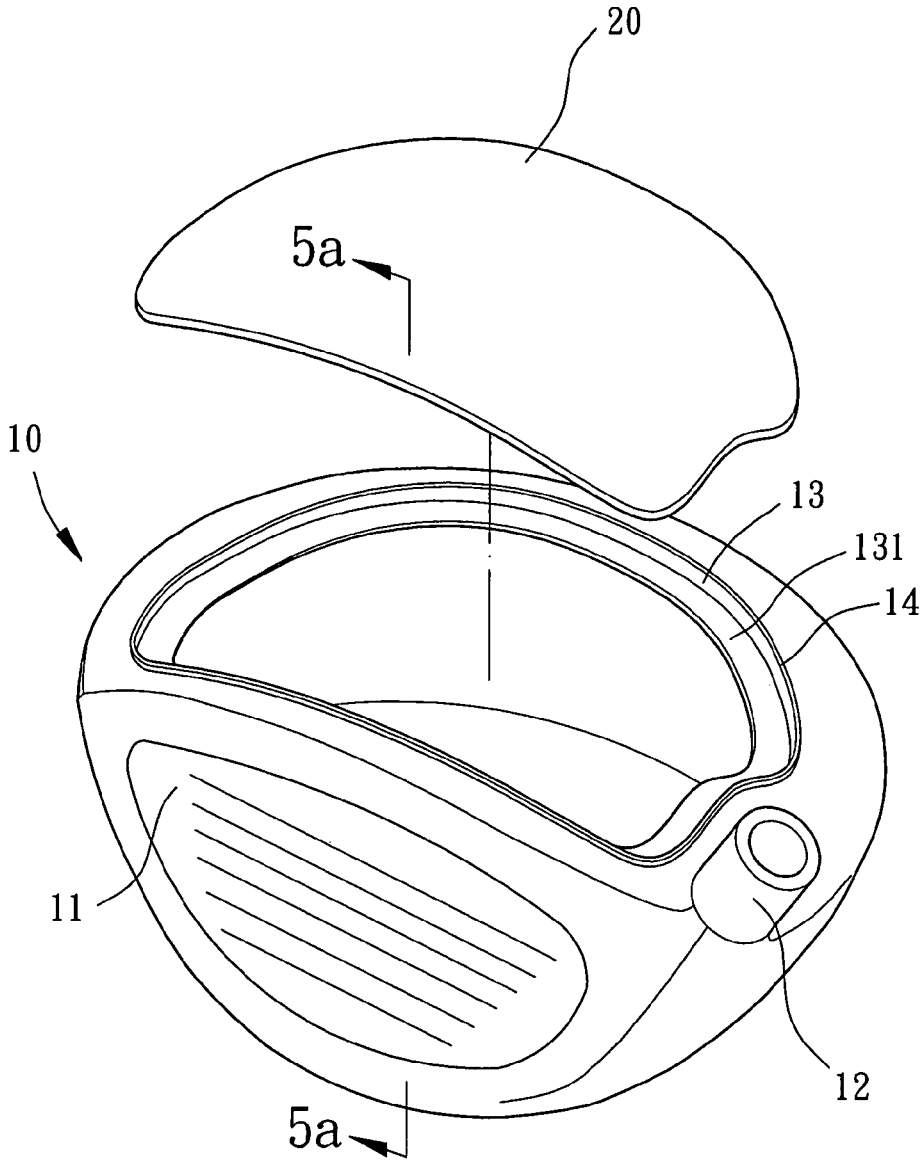
FIG. 5 is a perspective view, partly exploded, of a second embodiment of the golf club head in accordance with the present invention.
Figure 5A:
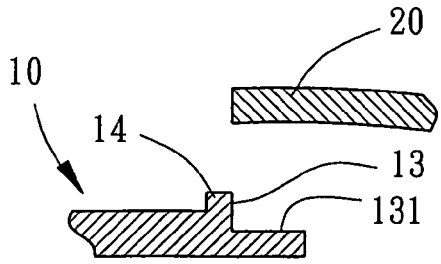
FIG. 5*a* is a partial exploded sectional view of the golf club head in FIG. 5.

FIGS. 5 and 5*a* illustrate a second embodiment of the golf club head in accordance with the present invention, wherein the perimeter wall delimiting the assembling opening 13 includes a perimeter flange 14 projecting outward. The perimeter flange 14 prevents the brazing material 4 from flowing outward during the high-temperature brazing procedure. This assures filling of a sufficient amount of molten brazing material 4 into the gaps between the cover plate 20 and the perimeter wall delimiting the assembling opening 13. In other words, the perimeter flange 14 assures reliable bonding of the brazing bonding portions 40. The perimeter flange 14 is removed by grinding after brazing.

Figure 6:
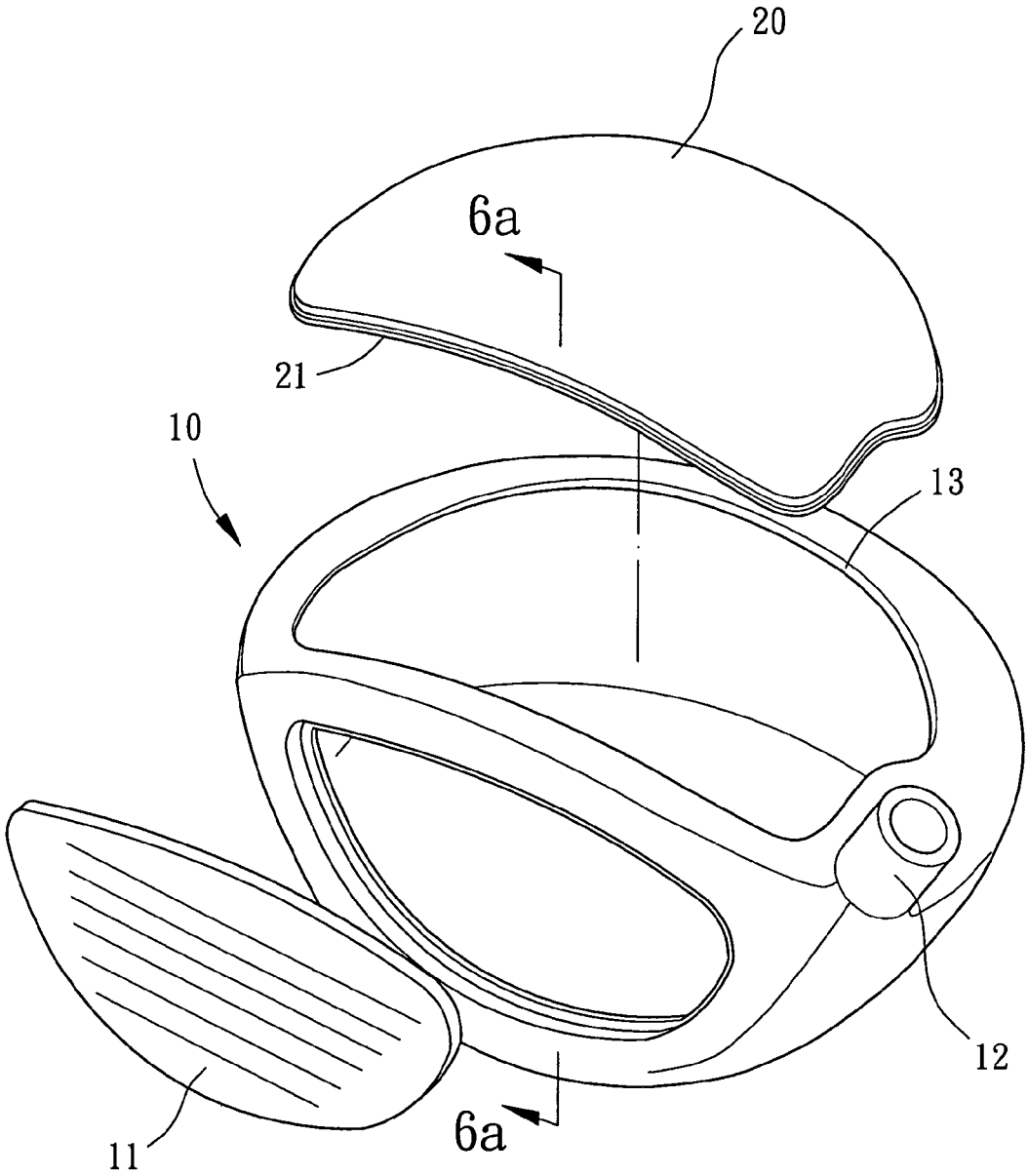
FIG. 6 is a perspective view, partly exploded, of a third embodiment of the golf club head in accordance with the present invention.
Figure 6A:
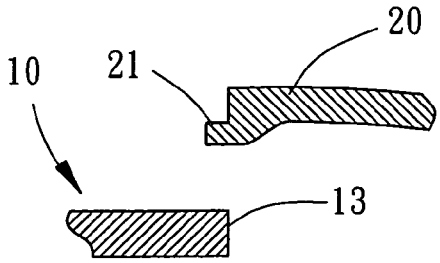
FIG. 6*a* is a partial exploded sectional view of the golf club head in FIG. 6.

FIGS. 6 and 6*a* illustrate a third embodiment of the golf club head in accordance with the present invention. In this embodiment, the cover plate 20 includes a perimeter flange 21 along a bottom of a perimeter thereof, and the stepped portion 131 in the assembling opening 13 in the first embodiment is omitted. Thus, the cover plate 20 is supported by the perimeter wall delimiting the assembling opening 13. It is noted that the cover plate 20 can be supported by other means. Next, spot welding points 30 and high-temperature brazing are carried out in a manner similar to the first embodiment (see FIGS. 2, 3, 4, and 4*a*).

Figure 7:
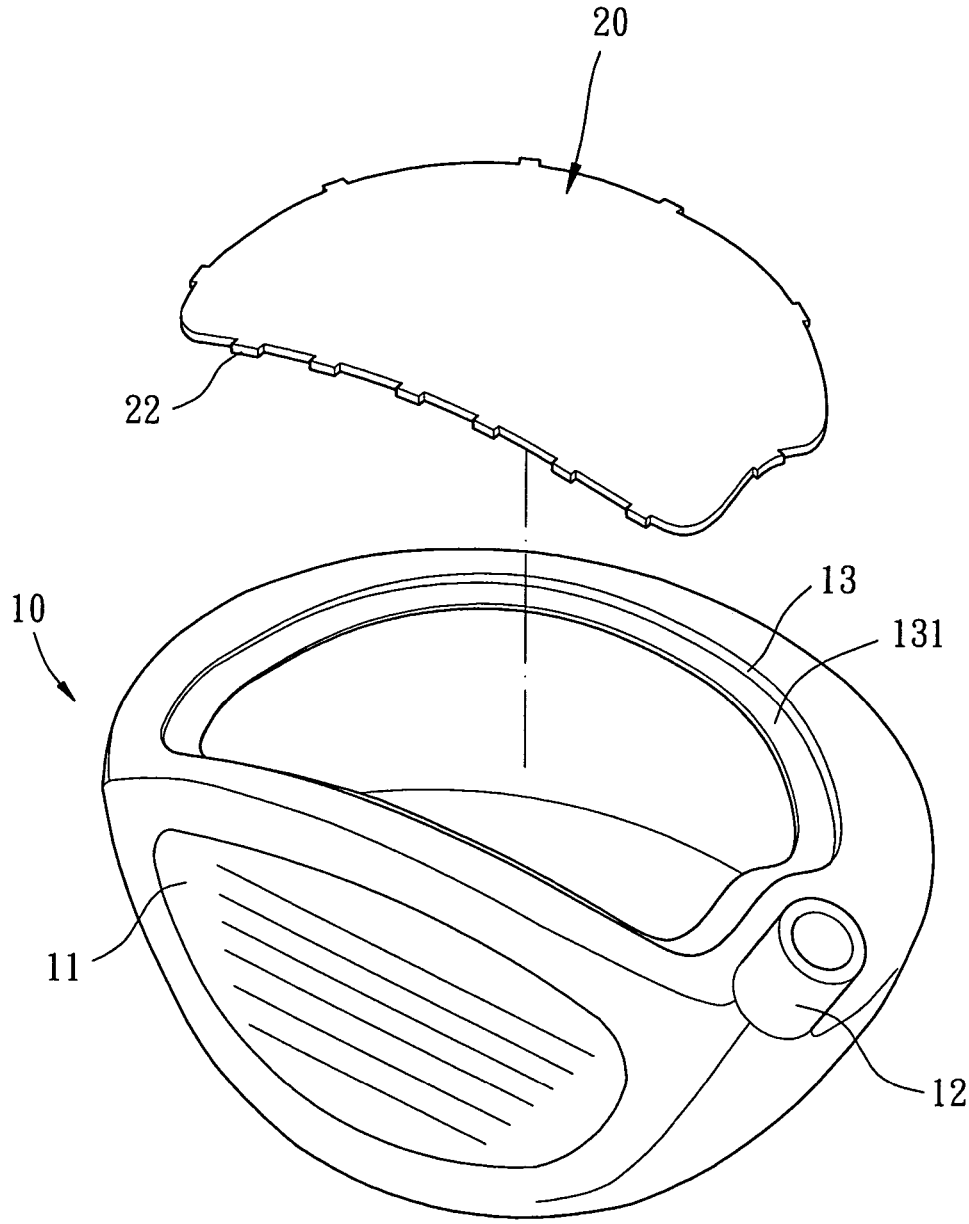
FIG. 7 is a perspective view, partly exploded, of a fourth embodiment of the golf club head in accordance with the present invention.
Figure 8:
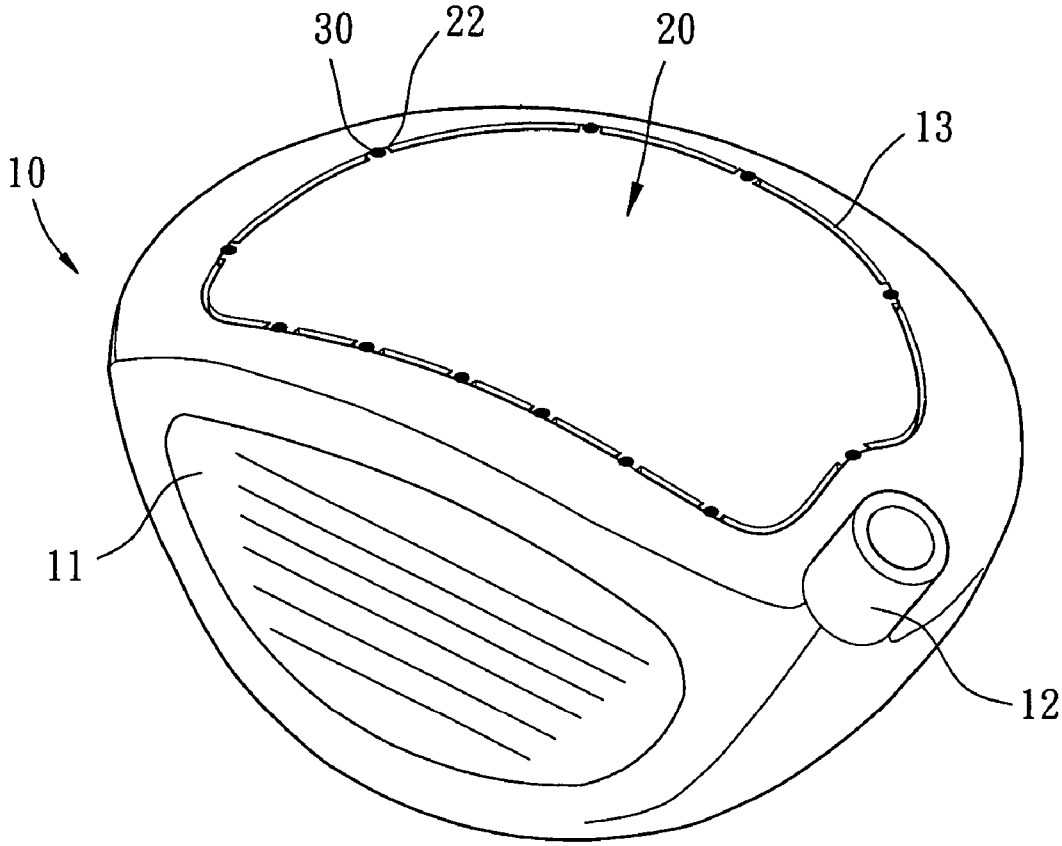
FIG. 8 is a perspective view of the golf club head in FIG. 7, illustrating a process of spot welding.

FIGS. 7 and 8 illustrate a fourth embodiment modified from the first embodiment. In this embodiment, the cover plate 20 includes a plurality of lugs 22 on a perimeter thereof. In assembly, the lugs 22 abut against the perimeter wall delimiting the assembling opening 13. The width of the joint area between the cover plate 20 and the perimeter wall delimiting the assembling opening 13 is thus reduced, which is advantageous to the subsequent high-energy welding for forming the spot welding points 30, thereby improving the bonding reliability. Further, the space between a pair of lugs 22 is larger to allow filling of sufficient amount of brazing material 4 for forming the brazing bonding portions 40. Thus, the bonding reliability provided by the spot welding points 30 and the brazing bonding portions 40 can be improved by the provision of the lugs 22.

Figure 9:
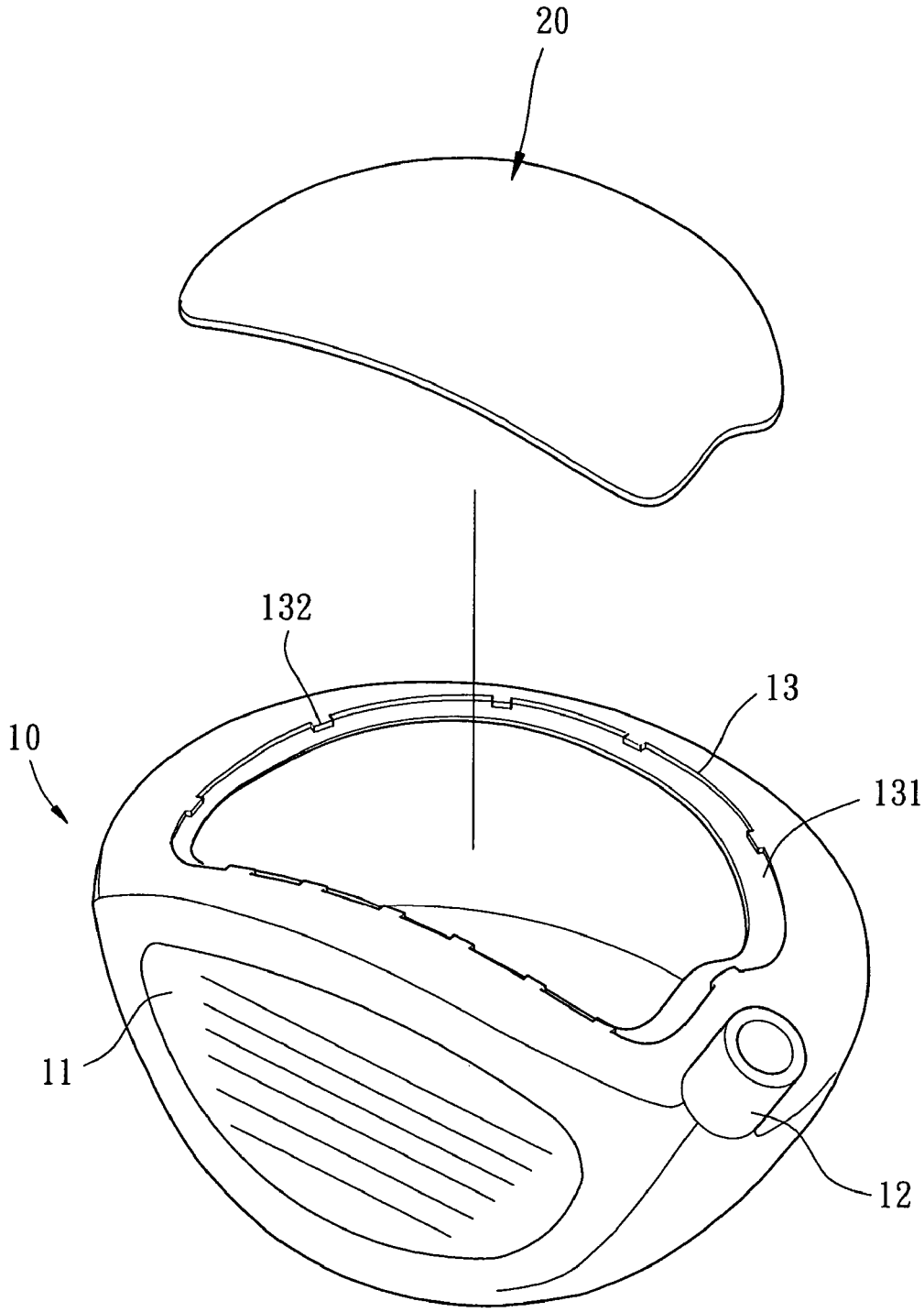
FIG. 9 is a perspective view, partly exploded, of a fifth embodiment of the golf club head in accordance with the present invention.
Figure 10:
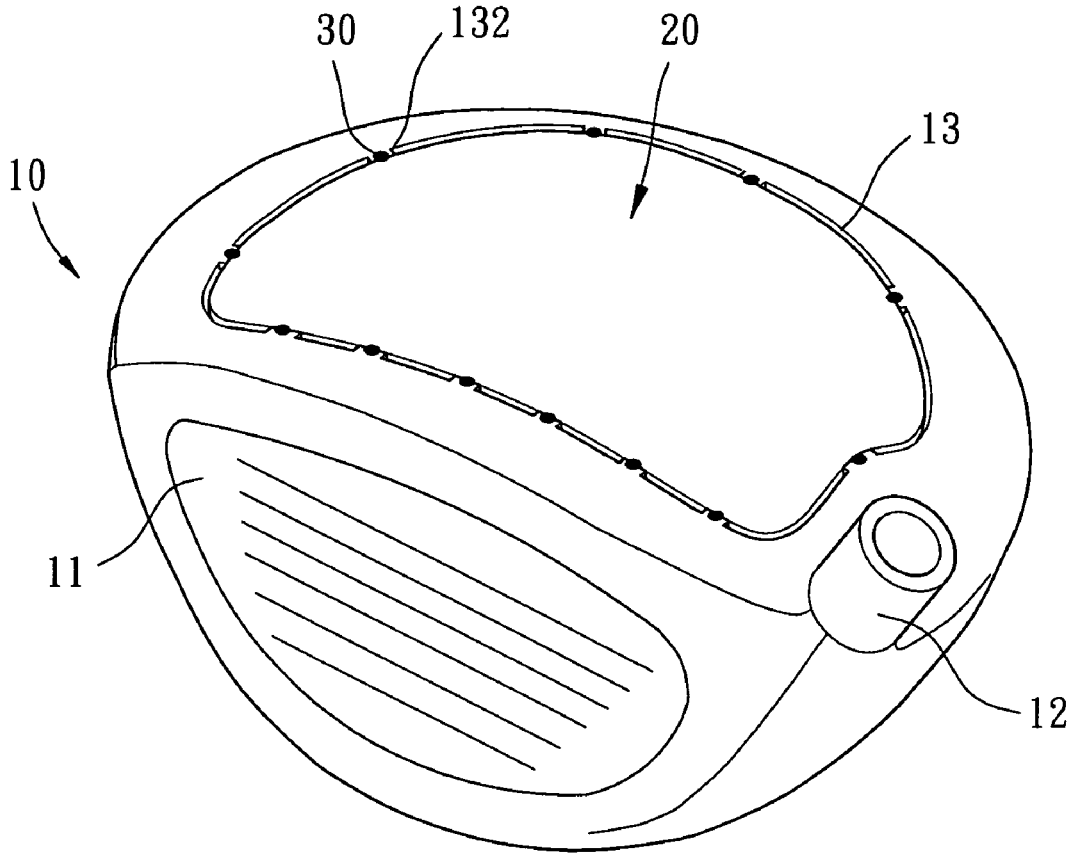
FIG. 10 is a perspective view of the golf club head in FIG. 9, illustrating a process of spot welding.

FIGS. 9 and 10 illustrate a fifth embodiment modified from the first embodiment. In this embodiment, the perimeter wall delimiting the assembling opening 13 of the body 10 includes a plurality of inwardly projecting lugs 132. In assembly, the perimeter of the cover plate 20 abuts against the lugs 132. The width of the joint area between the cover plate 20 and the perimeter wall delimiting the assembling opening 13 is thus reduced, which is advantageous to the subsequent high-energy welding for forming the spot welding points 30, thereby improving the bonding reliability. Further, the space between a pair of lugs 132 is larger to allow filling of sufficient amount of brazing material 4 for forming the brazing bonding portions 40. Thus, the bonding reliability provided by the spot welding points 30 and the brazing bonding portions 40 can be improved by the provision of the lugs 132.

The lugs 22 in the fourth embodiment and the lugs 132 in the fifth embodiment provide a reference for forming the spot welding points. In other words, positions of the lugs 22 and 132 are the positions for forming the spot welding points.

As apparent from the foregoing, the problems in the prior art are avoided by the golf club heads and the method for manufacturing the golf club heads in accordance with the present invention. The bonding in the joint area between the front edge of the cover plate 20 and the associated portion of the perimeter wall delimiting the assembling opening 13 is reliable. The manufacturing cost is low and the qualified product rate is increased.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A method for manufacturing a golf club head, comprising:

preparing a golf club head body with at least one assembling opening provided on at least one of a crown portion, a sole portion, a rear portion, and a skirt portion of the body, with a perimeter wall of said at least one assembling opening including an outwardly projecting perimeter flange;

preparing at least one cover plate and placing said at least one cover plate in said at least one assembling opening;

forming a plurality of spot welding points along a joint area between said at least one cover plate and the perimeter wall of said at least one assembling opening by welding;

applying a brazing material along the joint area between said at least one cover plate and the perimeter wall of said at least one assembling opening;

melting the brazing material by heating to cause molten brazing material to fill gaps between said at least one cover plate and the perimeter wall of said at least one assembling opening, thereby forming a brazing bonding portion between a pair of the spot welding points adjacent to each other; and removing the outwardly projecting perimeter flange after formation of the brazing bonding portions;

wherein the outwardly projecting perimeter flange prevents the brazing material from flowing out of the perimeter wall of said at least one assembling opening.

2. The method as claimed in claim 1, wherein the perimeter wall of said at least one assembling opening includes a stepped portion for supporting said at least one cover plate.

3. The method as claimed in claim 1, wherein said at least one cover plate includes a perimeter flange along a bottom of a perimeter thereof, the perimeter flange engaging with the perimeter wall of said at least one assembling opening.

4. The method as claimed in claim 1, wherein the spot welding points are formed by high-energy welding using a high-energy source.

5. The method as claimed in claim 4, wherein the high-energy source is one of a laser beam, electronic beam, and plasma.

6. The method as claimed in claim 1, wherein the spot welding points are formed by welding in an Argon-protected environment.

7. The method as claimed in claim 1, wherein the spot welding points are formed by high-energy full-penetration welding via a high-energy source.

8. The method as claimed in claim 1, wherein the perimeter wall of said at least one assembling opening is made of one of metal and alloy.

9. The method as claimed in claim 1, wherein said at least one cover plate is made of one of metal and alloy.

10. The method as claimed in claim 1, wherein said at least one cover plate has a thickness of 0.1-1.0 mm.

11. The method as claimed in claim 1, wherein said at least one cover plate includes a plurality of lugs on a perimeter thereof for indicating positions for forming the spot welding points, and wherein a brazing material for toning each said brazing bonding portion is filled into a space between a pair of the lugs.

12. The method as claimed in claim 1, wherein the perimeter wall of said at least one assembling opening includes a plurality of inwardly projecting lugs for supporting a perimeter of said at least one cover plate and for indicating positions for forming the spot welding points, and wherein a brazing material for forming each said brazing bonding portion is filled into a space between a pair of the lugs.

* * * * *